US009212836B2

(12) United States Patent
Welch

(10) Patent No.: US 9,212,836 B2
(45) Date of Patent: Dec. 15, 2015

(54) HEAT EXCHANGER

(75) Inventor: Andrew M Welch, Mt. Wolf, PA (US)

(73) Assignee: Johnson Controls Technology Company, Holland, MI (US)

( * ) Notice: Subject to any disclaimer, the term of this patent is extended or adjusted under 35 U.S.C. 154(b) by 1043 days.

(21) Appl. No.: 12/809,839

(22) PCT Filed: Jan. 2, 2009

(86) PCT No.: PCT/US2009/030027

§ 371 (c)(1), (2), (4) Date: Jun. 21, 2010

(87) PCT Pub. No.: WO2009/089100

PCT Pub. Date: Jul. 16, 2009

(65) Prior Publication Data

US 2010/0275643 A1 Nov. 4, 2010

Related U.S. Application Data

(60) Provisional application No. 61/018,539, filed on Jan. 2, 2008.

(51) Int. Cl.

| | |
|---|---|
| ***F28F 9/22*** | (2006.01) |
| ***F25B 39/04*** | (2006.01) |
| ***F25B 40/02*** | (2006.01) |
| ***F28B 1/02*** | (2006.01) |
| ***F28D 7/00*** | (2006.01) |
| ***F28D 7/16*** | (2006.01) |
| ***F28D 21/00*** | (2006.01) |

(52) U.S. Cl.

CPC ..... *F25B 39/04* (2013.01); *F25B 40/02* (2013.01); *F28B 1/02* (2013.01); *F28D 7/0075* (2013.01); *F28D 7/1646* (2013.01); *F28D 21/0017* (2013.01); *F25B 2339/047* (2013.01); *F28F 2009/224* (2013.01)

(58) Field of Classification Search

CPC ..... F25B 2339/046; F25B 2339/047; F25B 39/04; F25B 40/02; F28B 1/02; F28B 9/06; F28F 2009/222; F28F 2009/224; F28F 7/0075; F28F 9/22; Y10S 165/205; Y10S 165/215; Y10S 165/413; F28D 7/0075; F28D 7/1607; F28D 7/1646; F28D 21/0017; F28D 1/0206; F28D 1/0408; F28D 1/05316

USPC ..... 62/498, 503, 509, 181, 478, 512, 513; 165/70, 71, 113, 114, 157, 158, 159, 165/163, 162, 110, 111, 112, 115, 116, 117, 165/118, 160, 161

See application file for complete search history.

(56) References Cited

U.S. PATENT DOCUMENTS

| | | | | |
|---|---|---|---|---|
| 1,672,650 | A * | 6/1928 | Lonsdale | 165/160 |
| 2,392,638 | A * | 1/1946 | Bowman et al. | 165/111 |
| 2,864,589 | A * | 12/1958 | Booth et al. | 165/299 |
| 4,726,418 | A * | 2/1988 | Mihailov | 165/113 |

(Continued)

FOREIGN PATENT DOCUMENTS

| | | |
|---|---|---|
| JP | 08233408 | 9/1996 |

*Primary Examiner* — Mohammad M Ali
*Assistant Examiner* — Christopher R Zerphey
(74) *Attorney, Agent, or Firm* — McNees Wallace & Nurick LLC

(57) ABSTRACT

A condenser includes a shell having a vapor refrigerant inlet, a first tube bundle and a liquid refrigerant outlet. A second tube bundle is positioned in a subcooler component. The subcooler component has a center channel and at least two outer channels and conforms to the shell.

7 Claims, 7 Drawing Sheets

(56) References Cited

U.S. PATENT DOCUMENTS 5,509,466 A * 4/1996 McQuade et al. ..... 165/113
5,836,382 A * 11/1998 Dingle et al. ..... 165/160
6,296,049 B1 * 10/2001 Ozeki et al. ..... 165/114
2006/0289153 A1 * 12/2006 Mulder ..... 165/160

* cited by examiner

HEAT EXCHANGER

CROSS-REFERENCE TO RELATED APPLICATIONS

This application claims priority to related application U.S. Provisional Application No. 61/018,539, entitled "CONDENSER SUBCOOLER," filed Jan. 2, 2008, which is hereby incorporated by reference.

BACKGROUND

The application generally relates to condensers in vapor compression systems. The application relates more specifically to a second heat exchanger for a condenser of a vapor compression system.

In some conventional condensers, condenser tubes may be used to circulate a fluid that can exchange heat with refrigerant vapor entering the condenser, causing the refrigerant vapor to condense to a liquid. Before the refrigerant liquid leaves the condenser, the refrigerant liquid may be further cooled by a second heat exchanger that includes tubes positioned in a component in the condenser. The component controls the flow of the refrigerant liquid over the tubes, which also circulate a fluid to exchange heat with the refrigerant liquid.

In many applications, only liquid refrigerant should enter the component, as vapor entering the component may decreases the efficiency of the second heat exchanger because the rate of convective heat transfer for the refrigerant in the vapor phase is much less than in the liquid phase. Further, allowing refrigerant vapor to enter the component may result in refrigerant vapor leaving the condenser, which may decrease the efficiency of the system, because a reduced amount of refrigerant liquid is provided to the remainder of the system.

To prevent refrigerant vapor from entering the component, the component can be submerged in a reservoir of refrigerant liquid that extends along the length of the condenser. The refrigerant liquid reservoir forms a liquid seal that prevents refrigerant vapor from entering the component. The significant amount of refrigerant liquid required to form the liquid seal can contribute to the initial and operating costs of the condenser because of the cost associated with refrigerant that cannot be used towards system capacity.

SUMMARY

The second heat exchanger includes outer channels and a center channel for directing the flow of refrigerant liquid within the second heat exchanger. The second heat exchanger reduces the refrigerant quantity required in a condenser by reconfiguring the second heat exchanger to better conform to the inside of the condenser shell.

The present invention relates to a vapor compression system including a compressor, a condenser, an expansion device and an evaporator connected in a closed refrigerant loop. The condenser includes a shell, a first tube bundle, and a second tube bundle. The second tube bundle is disposed in a component configured to prevent refrigerant vapor from contacting the second tube bundle.

The present invention further relates to a heat exchanger for a condenser including a shell, a first tube bundle, and a second tube bundle. The second tube bundle is disposed in a component configured to prevent refrigerant vapor from contacting the second tube bundle.

The present invention also relates to a heat exchanger including a shell, a component, and a tube bundle disposed in the component. The component substantially conforms to the shell and is configured to prevent refrigerant vapor from contacting the tube bundle.

Certain advantages of the embodiments described herein are improved liquid subcooling and cost reduction and improved environmental operations through reduced refrigerant charge requirements.

DETAILED DESCRIPTION OF THE EXEMPLARY EMBODIMENTS

Figure 1:
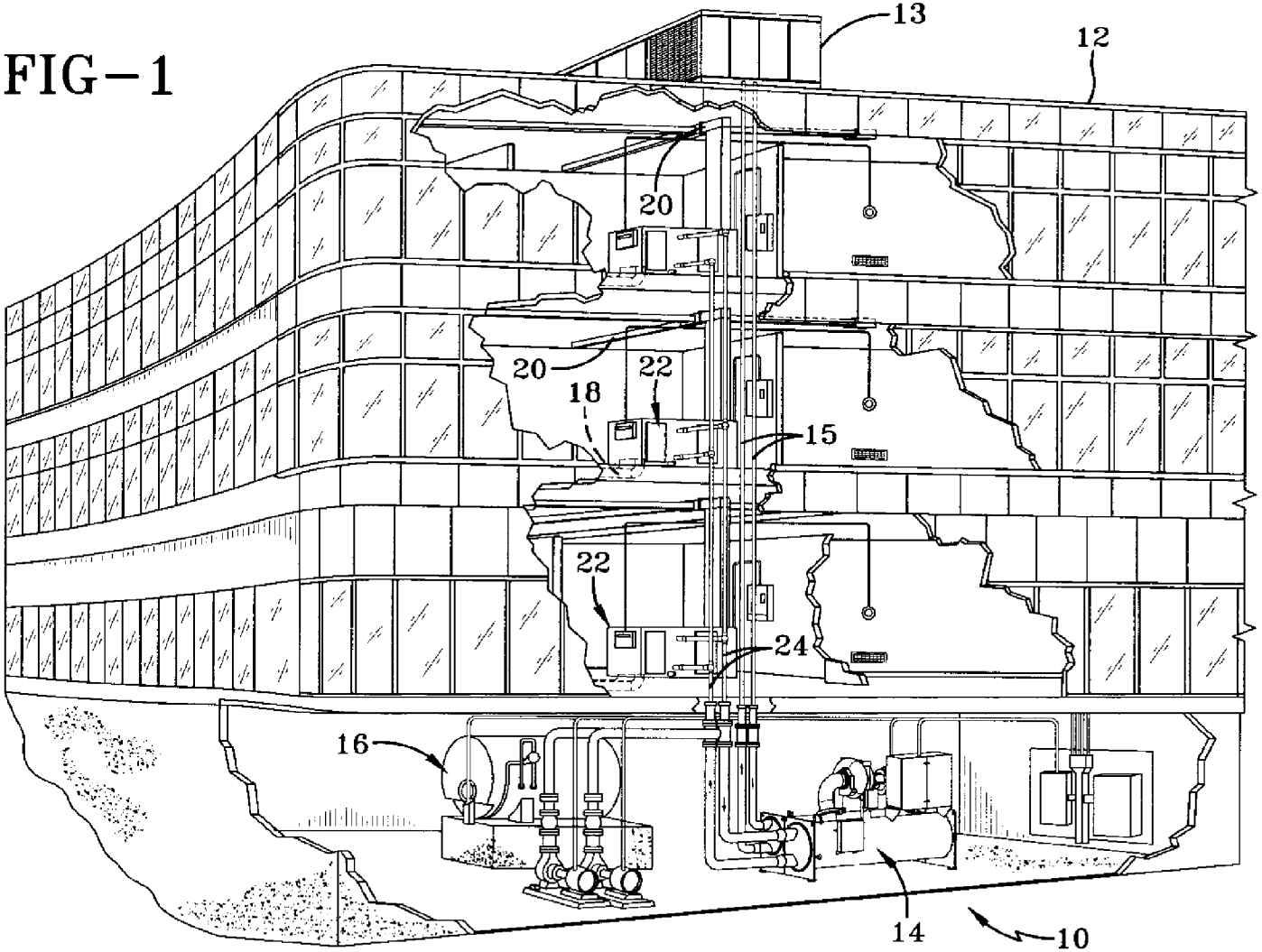
FIG. 1 shows an exemplary embodiment of a heating, ventilation and air conditioning system in a commercial setting.

FIG. 1 shows an exemplary embodiment of a heating, ventilation and air conditioning system 10 in a building 12 in a typical commercial setting. System 10 can include a vapor compression system 14 that can supply a chilled liquid to cool building 12, and a cooling tower 13 that can provide a fluid to compression system 14 by conduits 15. System 10 can also include a boiler 16 to supply a heated liquid that may be used to heat building 12, and an air distribution system that circulates air through building 12. The air distribution system can include an air return duct 18, an air supply duct 20 and an air handler 22. Air handler 22 can include a heat exchanger connected to boiler 16 and vapor compression system 14 by conduits 24. The heat exchanger in air handler 22 may receive heated liquid from boiler 16 and/or chilled liquid from vapor compression system 14, depending on the mode of operation of system 10. In an exemplary embodiment, system 10 can include a separate air handler on each floor of building 12, but it will be appreciated that the components may be shared between or among floors.

Figure 2:
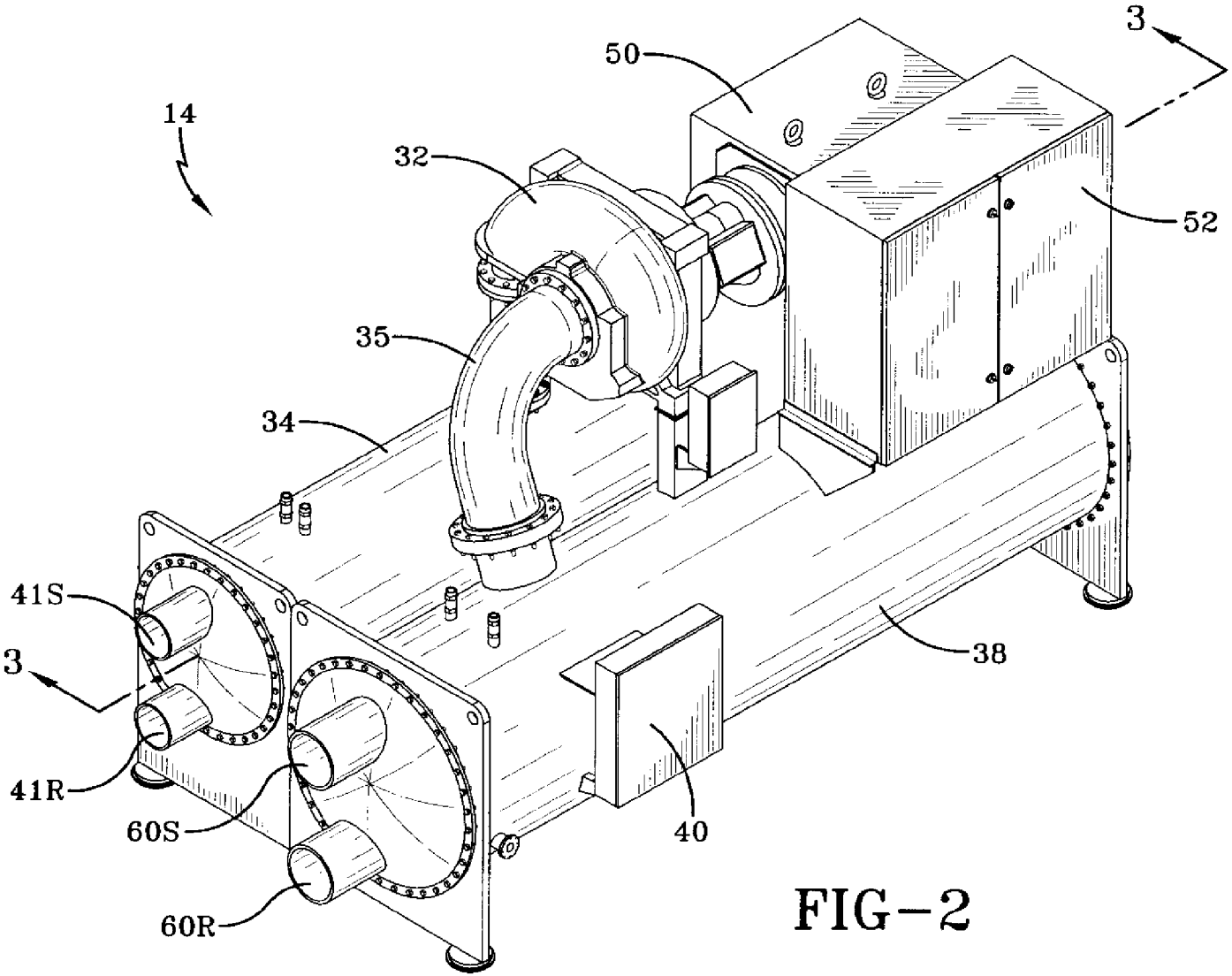
FIG. 2 shows an exemplary embodiment of a vapor compression system.

FIG. 2 shows an exemplary embodiment of vapor compression system 14. Vapor compression system 14 includes a compressor 32 driven by a motor 50, a condenser 34, an expansion device(s) (not shown), and an evaporator 38. A refrigerant is circulated through vapor compression system 14 in a vapor compression cycle. Vapor compression system 14 can also include a control panel 40 to control operation of vapor compression system 14.

In the exemplary embodiment of FIG. 2, motor 50 is powered by a variable speed drive (VSD) 52. In another embodiment, motor 50 may be powered directly from an alternating current (AC) or direct current (DC) power source (not shown). VSD 52 receives AC power having a particular fixed line voltage and fixed line frequency from an AC power source (not shown) and provides power having a variable voltage and frequency to motor 50. Motor 50 can be any type of electric motor that can be powered by a VSD 52 or directly from an AC or DC power source. For example, motor 50 can be a switched reluctance motor, an induction motor, an electronically commutated permanent magnet motor or any other suitable motor type. In an alternate exemplary embodiment, other drive mechanisms such as steam or gas turbines or engines and associated components can be used to drive compressor 32.

Compressor 32 compresses a refrigerant vapor from evaporator 38 and delivers refrigerant vapor to condenser 34 through a discharge line 35. Compressor 32 can be a centrifugal compressor, screw compressor, reciprocating compressor, rotary compressor, swing link compressor, scroll compressor, turbine compressor, or any other suitable compressor.

Evaporator 38 includes an internal tube bundle (not shown), and a supply line 60S and a return line 60R for supplying and removing a process fluid to the internal tube bundle. Supply line 60S and return line 60R can be in fluid communication with air handler 22 via conduits 24 that circulate the process fluid through the system 10. The process fluid may be a chilled liquid for cooling building 12 (FIG. 1). Evaporator 38 lowers the temperature of the process fluid as the process fluid passes through the tube bundle of evaporator 38 and exchanges heat with the refrigerant. The tube bundle can include a plurality of tubes and a plurality of bundles of tubes. The process fluid, may be, but is not limited to water, ethylene glycol, calcium chloride brine, sodium chloride brine, or any other suitable liquid.

Refrigerant vapor is formed in evaporator 38 by the refrigerant liquid delivered to evaporator 38 exchanging heat with the process fluid and undergoing a phase change to refrigerant vapor. Some examples of fluids that may be used as refrigerants in vapor compression system 14 are hydrofluorocarbon (HFC) based refrigerants, for example, R-410A, R-407, R-134a, or any other suitable type of refrigerant.

Refrigerant vapor delivered by compressor 32 to condenser 34 transfers heat to a fluid. Refrigerant vapor condenses to refrigerant liquid in condenser 34 as a result of heat transfer with the fluid. The refrigerant liquid from condenser 34 flows through an expansion devise (not shown) and is returned to evaporator 38 to complete the refrigerant cycle of vapor compression system 14. Condenser 34 includes a supply line 41S and a return line 41R for circulating fluid between condenser 34 and cooling tower 13. At cooling tower 13, the fluid from condenser 34 is cooled by exchanging heat with another fluid such as air. The fluid is then returned to condenser 34 through return line 41R, where the fluid is heated by exchanging heat with the refrigerant in the condenser 34. The heated fluid is then removed from the condenser 34 though supply line 40S and provided to the cooling tower 13 to complete the cycle. The fluid may be water, but can be any other suitable liquid.

Figure 3:
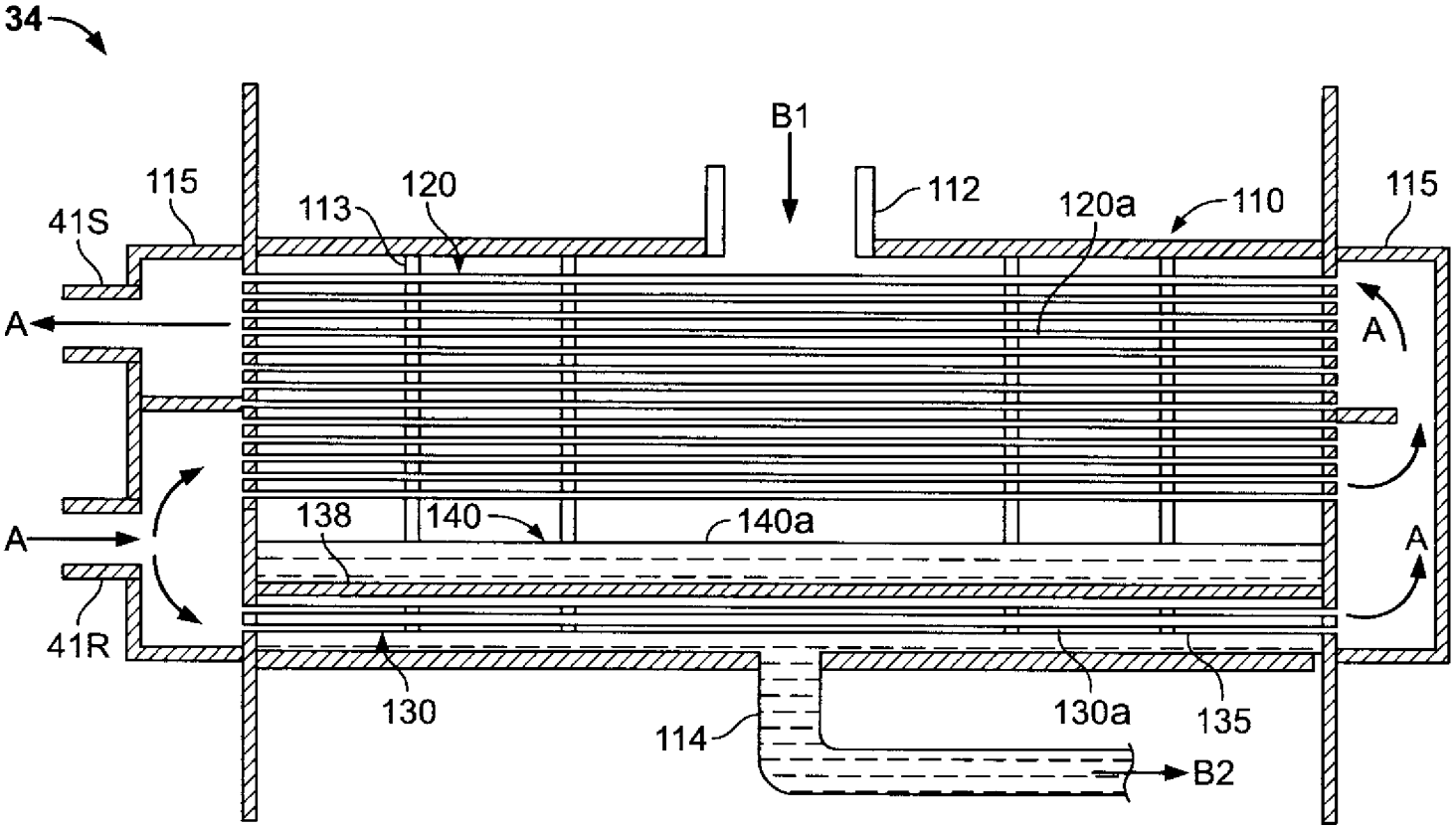
FIG. 3 shows a cross-sectional view of an exemplary embodiment of the condenser of FIG. 2.

A cross sectional view of condenser 34 is shown in FIG. 3. As shown in FIG. 3, condenser 34 includes a shell 110 having a generally cylindrical geometry and includes headers or distributors 115 positioned at opposing axial ends of shell 110. Headers 115 distribute fluid to a first tube bundle 120 and a second tube bundle 130 as shown by the arrows "A". The flow path of the fluid through condenser 34 is also shown by arrows "A".

Condenser 34 further includes an inlet 112 for receiving refrigerant vapor as indicated by arrow "B1" and an outlet 114 for discharging refrigerant liquid as indicated by arrow "B2". In an exemplary embodiment, inlet 112 and outlet 114 are located at approximately the axial midpoint of condenser 34. In another embodiment, the location of inlet 112 and outlet 114 may vary in position along shell 110.

First tube bundle 120 includes tubes 120*a* that exchange heat with refrigerant vapor entering condenser 34, causing the refrigerant vapor to condense to refrigerant liquid. In this exemplary embodiment, first tube bundle 120 is a single pass tube bundle, however, in alternative embodiments, first tube bundle 120 can be a multi-pass tube bundle. In one embodiment, first tube bundle 120 can be a two pass tube bundle. Before, the refrigerant liquid leaves condenser 34 through outlet 114, the refrigerant liquid can be further cooled to a temperature below the saturation temperature of the refrigerant, that is, subcooled, by tubes 130*a* located in a component 135 of condenser 34 containing second tube bundle 130. Component 135 controls the flow of the refrigerant liquid over tubes 130*a*. Component 135, second tube bundle 130 and tubes 130*a* can be referred to as a subcooler. Condenser 34 includes tube supports 113 for supporting tubes 120*a* and tubes 130*a*.

As further shown in FIG. 3, component 135 is submerged in a liquid reservoir 140 that extends along the full length of condenser 34. Liquid reservoir 140 has a liquid surface 140*a* above component 135. Liquid reservoir 140 forms a liquid seal that prevents refrigerant vapor from entering the subcooler component 135. Liquid surface 140*a* can be lower than a top surface 138 of component 135. In an exemplary embodiment, liquid surface 140*a* can be located relative to component 135 so as to prevent the flow of any refrigerant vapor into component 135, or in other words, above any inlet to component 135.

Figure 4:
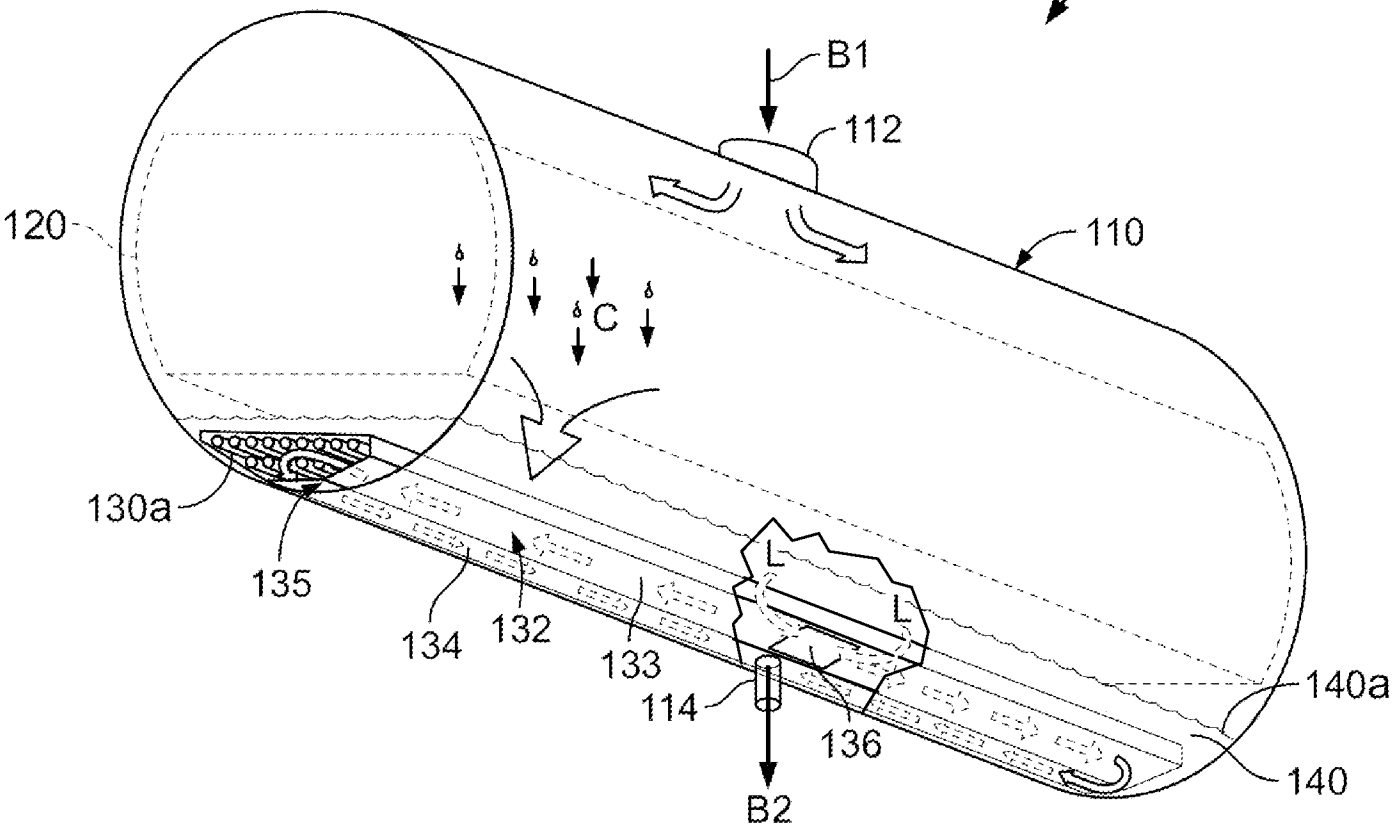
FIG. 4 shows a partial cut-away perspective view of an exemplary embodiment of a condenser.
Figure 5:
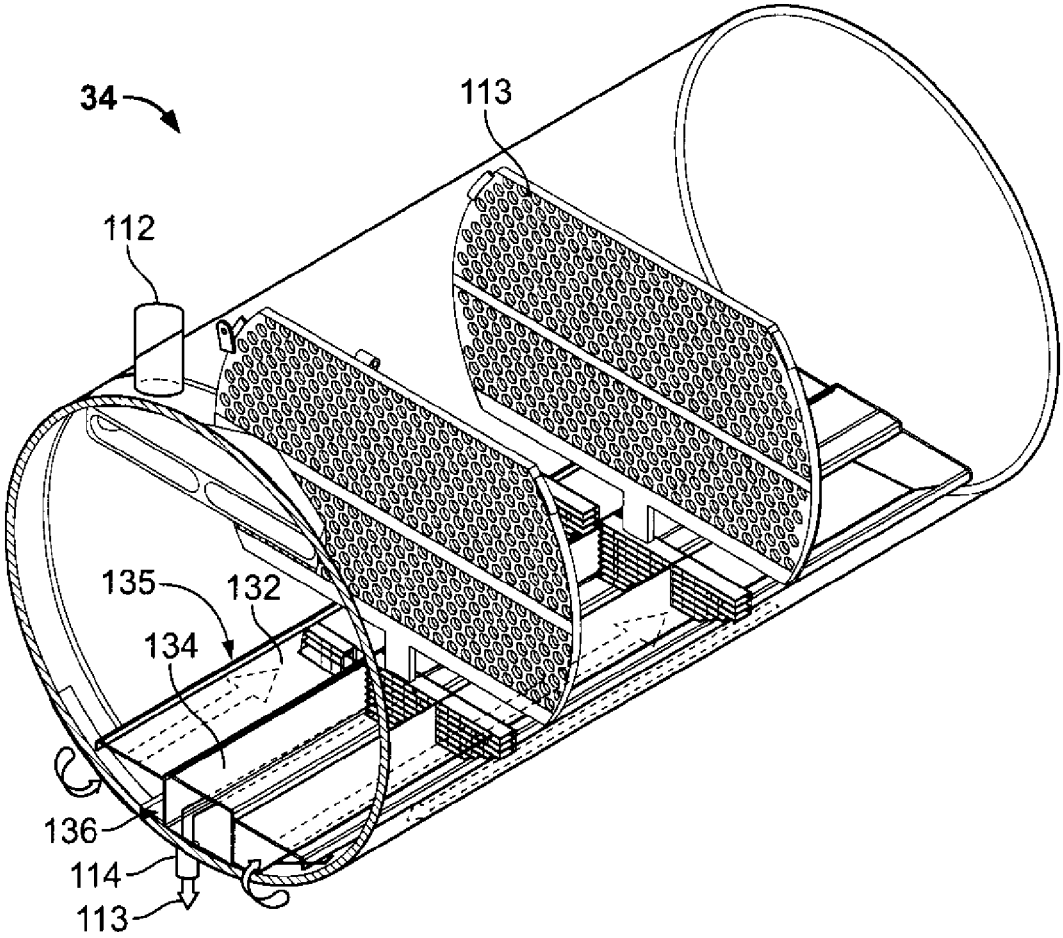
FIG. 5 shows a partial cut-away isometric cross-sectional view of an exemplary embodiment of a condenser.

FIGS. 4 and 5 show a simplified view of condenser 34 with first tube bundle 120 and headers 115 removed. In FIG. 5, tubes 130*a* are further removed, and the flow of condensed refrigerant is shown by arrows "C". Condensed refrigerant collects and forms liquid reservoir 140. The refrigerant liquid then enters the component 135 through inlets 136 as indicated by arrows "L".

Second tube bundle 130 provides additional cooling to the refrigerant liquid. Refrigerant liquid enters component 135 and contacts and flows over tubes 130*a*. Tubes 130*a* circulate the same fluid as tubes 120*a* to exchange heat to further cool or sub-cool, that is, lower the temperature of the refrigerant liquid.

Component 135 includes outer channels 132 and a center channel 134. Outer channels 132 include bottom walls 133 with inlets 136. In one embodiment, component 135 includes two outer channels 132. In another embodiment, component 135 includes at least two outer channels 132. Liquid refrigerant collected in the liquid reservoir 140 enters component 135 through inlets 136 and flows over tubes 130*a* in outer channels 132 towards headers plates 115 as shown by the dashed arrows in FIG. 4, providing a first pass for the refrigerant liquid. Inlets 136 can be located approximately at the axial midpoint of the condenser 34. In another embodiment, inlets 136 can be located at any location along the bottom walls 133. In the exemplary embodiment shown in FIG. 4, outer channel 132 includes a single inlet 136, however, in alternative embodiments, outer channel 132 may be provided with more than one inlet 136. The refrigerant liquid reservoir 140 forms a liquid seal at inlets 136 to substantially prevent refrigerant vapor from entering component 135.

After refrigerant liquid flows through outer channels 132 towards headers 115, liquid refrigerant is directed to center channel 134 as indicated by the arrows in FIGS. 4 and 5, where the refrigerant liquid flows over and around tubes 130*a* towards outlet 114. At outlet 114, refrigerant liquid flows from condenser 34.

Figure 6:
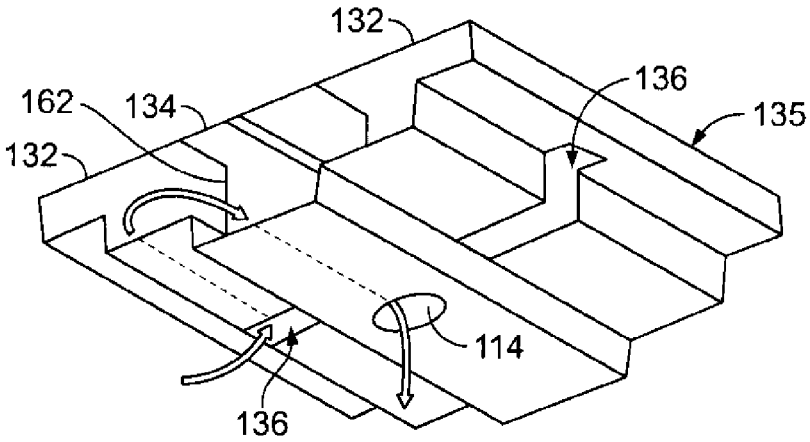
FIG. 6 shows a perspective view of an exemplary embodiment of a second heat exchanger for a condenser.

FIG. 6 shows component 135 and the arrangement between outer channels 132 and inner channel 134. Outer channels 132 include passages 162 that provide fluid communication between outer channels 132 and inner channel 134. In another embodiment, component 135 may include endcaps or headers (not shown) to provide fluid communication between outer channels 132 and inner channel 134.

Figure 7:
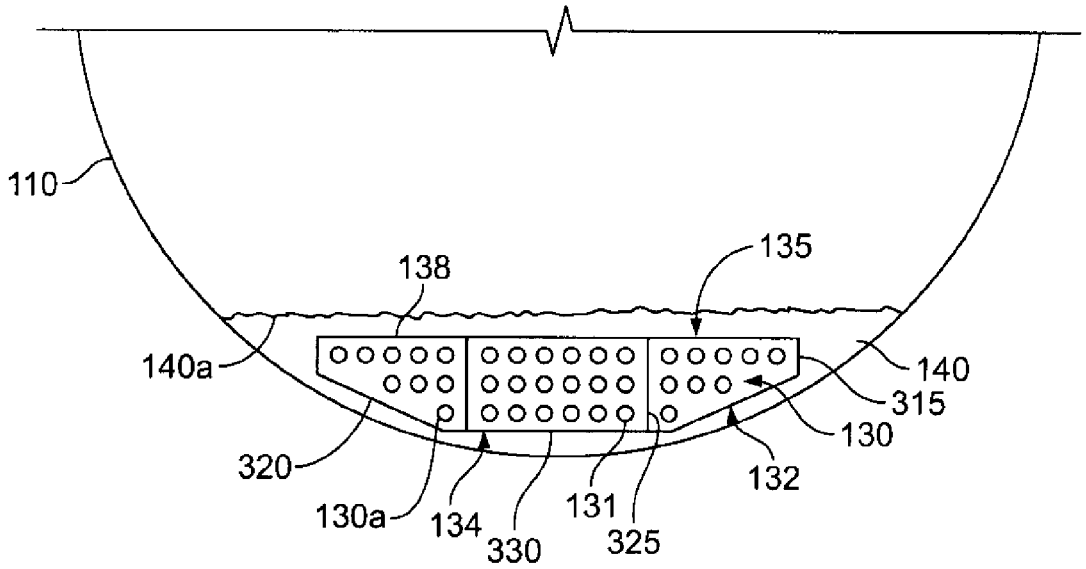
FIG. 7 shows a partial end view of an exemplary embodiment of a condenser.

FIG. 7 shows a partial end view of component 135. Outer channels 132 can be positioned on both sides of center channel 134. Second tube bundle 130 includes an exemplary distribution of tubes 130*a*, however, the number and distribution of tubes 130*a* may vary. Component 135 includes top surface 138 extending substantially uniformly across component 135, that is, top surface 138 can be substantially planar across component 135. Outer channels 132 include outer walls 315 and bottom walls 133. Center channel 134 includes outer walls 325 and bottom wall 330. Outer walls 325 form the inner wall of outer channels 132. The flow volume of outer channels 132 equals the flow volume of center channel 134. Component 135 substantially conforms to shell 110, thereby reducing the amount of liquid refrigerant needed in condenser 34 to cover inlets 136.

Figure 8:
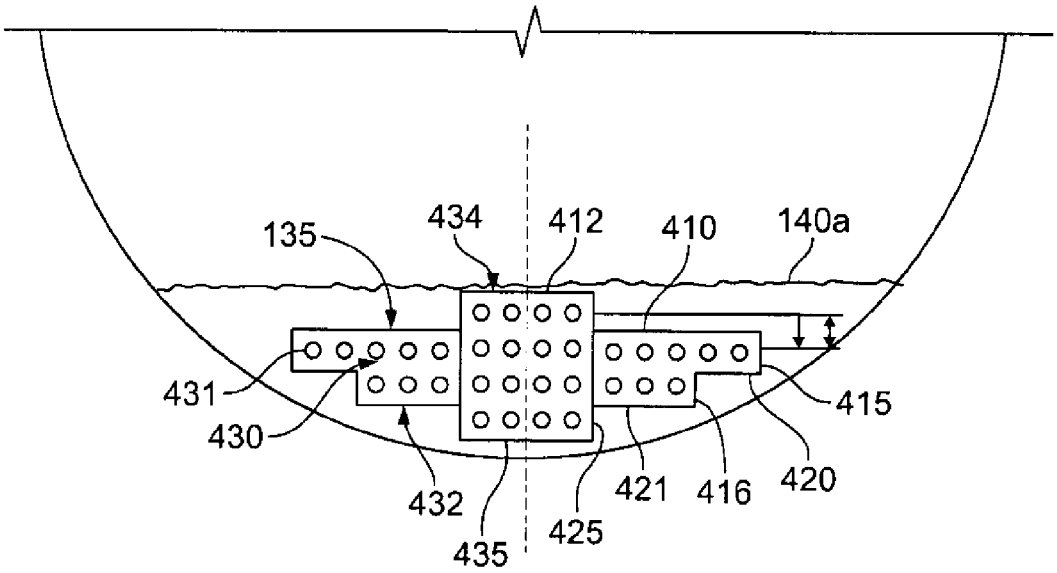
FIG. 8 is a partial end view of an exemplary embodiment of a condenser.

FIG. 8 shows an alternative embodiment of component 135. Component 135 includes outer channels 432 positioned on either side of center channel 434. Second tube bundle 430 includes an exemplary distribution of tubes 431, however, the number and distribution of tubes 431 may vary. Outer channels 432 include top walls 410, first outer end walls 415, second outer end walls 416, first bottom walls 420, and second bottom walls 421. Center channel 434 includes a top wall 412, outer walls 425, and a bottom wall 435. Top wall 412 of center channel 434 is positioned at a greater elevation than top walls 410 of outer channels 432, however, in exemplary embodiments, top wall 412 of center channel 434 may be continuous with top walls 410 of outer channels 432. The flow volume of outer channels 432 equals the flow volume of center channel 434, therefore, the cross-section of flow space for outer channels 432 must equal the cross-section of flow space for center channel 434. The stepped design of outer channels 432 allows component 135 to conform more closely to shell 110, which can result in the lowering of the liquid surface 140*a*, reducing the overall requirement for refrigerant liquid in the condenser 34 to cover inlets 136.

As shown in FIGS. 3, 4, 7 and 8, component 135 is submerged under liquid surface 140*a* of the liquid reservoir 140, however, in alternative embodiments, component 135 may be above liquid surface 140*a* of liquid reservoir 140. In one embodiment, component 135 is not completely submerged in liquid reservoir 140, and liquid surface 140*a* sufficiently covers component 135 to prevent vortexing of refrigerant liquid entering inlets 136 (FIG. 4). In one embodiment, component 135 conforms to shell 110, and the amount of refrigerant in liquid reservoir 140 can be reduced by between about 20% and about 65% over conventional condensers. In another embodiment, the amount of refrigerant in liquid reservoir 140 may be reduced by between about 30% and about 55% over conventional condensers.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

I claim:

1. A vapor compression system comprising:

a compressor, a condenser, an expansion device and an evaporator connected in a closed refrigerant loop; and the condenser comprising:

a shell;

a first tube bundle;

a subcooler component comprising a center channel and at least two outer channels disposed on opposing sidewalls of the center channel, the center channel and the at least two outer channels extending axially between first and second headers positioned at opposed ends of the shell and conforming to the shell, the center channel and the at least two outer channels being in direct contact with both the first header and the second header, each of the at least two outer channels having an inlet for permitting refrigerant flow into a corresponding outer channel;

at least a portion of a wall of each of the at least two outer channels having the inlet being spaced apart from the shell;

each outer channel having an outer portion opposite the sidewall of the center channel and an inner portion facing the sidewall of the center channel, the height of the inner portion being greater than the height of the outer portion;

a second tube bundle positioned within and surrounded by the center channel, the second tube bundle being operable to circulate a fluid to exchange heat with refrigerant liquid flowing through the center channel from the at least two outer channels; and each inlet configured to permit refrigerant liquid to enter the corresponding outer channel, refrigerant liquid flowing through the outer channel to an end of the outer channel adjacent one of the first header and the second header, refrigerant liquid then entering a passageway positioned at the end of the outer channel to permit flow of refrigerant liquid through the center channel, an axial direction of flow of the refrigerant liquid through the outer channel being opposite an axial direction flow of refrigerant liquid in the center channel;

wherein the center channel has an outlet for discharging refrigerant liquid from the condenser.

2. The refrigerant system of claim 1, wherein each inlet is formed in a bottom wall of each outer channel of the at least two outer channels.

3. The refrigerant system of claim 1, wherein the outlet is positioned at an axial center of the subcooler component.

4. A heat exchanger comprising:

a shell;

a first tube bundle;

a subcooler component comprising a center channel and at least two outer channels disposed on opposing sidewalls of the center channel, the center channel and the at least two outer channels extending axially between first and second headers positioned at opposed ends of the shell and conforming to the shell, the center channel and the at least two outer channels being in direct contact with both the first header and the second header, each of the at least two outer channels having an inlet for permitting refrigerant flow into a corresponding outer channel;

each outer channel having an outer portion opposite the sidewall of the center channel and an inner portion facing the sidewall of the center channel, the height of the inner portion being greater than the height of the outer portion;

a second tube bundle positioned within and surrounded by the center channel, the second tube bundle being operable to circulate a fluid to exchange heat with refrigerant liquid flowing through the center channel from the at least two outer channels; and each inlet configured to permit refrigerant liquid to enter the corresponding outer channel, refrigerant liquid flowing through the outer channel to an end of the outer channel adjacent one of the first header and the second header, refrigerant liquid then entering a passageway positioned at the end of the outer channel to permit flow of refrigerant liquid through the center channel, an axial direction of flow of the refrigerant liquid through the outer channel being opposite an axial direction flow of refrigerant liquid in the center channel;

wherein the center channel has an outlet for discharging refrigerant liquid from the condenser.

5. The heat exchanger of claim 4, wherein each inlet is formed in a bottom wall of each outer channel of the at least two outer channels.

6. The heat exchanger of claim 4, wherein the outlet is disposed at an axial center of the subcooler component.

7. A condenser comprising:

a shell, the shell comprising an inlet to receive vapor refrigerant and an outlet to discharge liquid refrigerant;

a liquid refrigerant reservoir positioned inside the shell opposite the inlet;

a subcooler positioned in the liquid refrigerant reservoir, the subcooler comprising a center channel and at least two outer channels disposed on opposing sidewalls of the center channel, the center channel and the at least two outer channels extending axially between first and second headers positioned at opposed ends of the shell and conforming to the shell, the center channel and the at least two outer channels being in direct contact with both the first header and the second header, each of the at least two outer channels having an inlet for permitting refrigerant flow into a corresponding outer channel;

each outer channel having an outer portion opposite the sidewall of the center channel and an inner portion facing the sidewall of the center channel, the height of the inner portion being greater than the height of the outer portion;

a tube bundle positioned in and surrounded by the center channel, the tube bundle being operable to circulate a fluid to exchange heat with refrigerant liquid flowing through the center channel from the at least two outer channels; and each inlet configured to permit refrigerant liquid to enter the corresponding outer channel, refrigerant liquid flowing through the outer channel to an end of the outer channel adjacent one of the first header and the second header, refrigerant liquid then entering a passageway positioned at the end of the outer channel to permit flow of refrigerant liquid through center inner channel, an axial direction of flow of the refrigerant liquid through the outer channel being opposite an axial direction flow of refrigerant liquid in the center channel;

wherein the center channel has an outlet for discharging refrigerant liquid from the condenser.

* * * * *